US005190148A

United States Patent [19]

Williams

[11] Patent Number: 5,190,148

[45] Date of Patent: Mar. 2, 1993

[54] MARINE KEY SWITCH

[75] Inventor: Thomas D. Williams, Mentor, Ohio

[73] Assignee: Delta Systems, Inc., Streetsboro, Ohio

[21] Appl. No.: 649,584

[22] Filed: Feb. 1, 1991

[51] Int. Cl.[5] ..... H01H 27/10

[52] U.S. Cl. ..... 200/43.08; 200/43.03; 200/334; 200/61.19; 200/DIG. 2; 70/DIG. 30; 123/198 DC

[58] Field of Search ..... 200/43.03, 43.04, 43.05, 200/43.08, 334, 336, 61.19, DIG. 2, 52 R, 564, 565, 570; 70/DIG. 30, 402; 123/198 DC

[56] References Cited

U.S. PATENT DOCUMENTS

| | | | |
|---|---|---|---|
| 2,763,753 | 9/1956 | Hasselbaum | 200/43.08 X |
| 2,777,023 | 1/1957 | Sepulveda | 200/43.04 X |
| 3,515,832 | 6/1970 | Martin | 200/43.08 X |
| 3,665,128 | 5/1972 | Schaad et al. | 200/43.04 |
| 3,769,481 | 10/1973 | Raab | 200/334 X |
| 3,801,767 | 4/1974 | Marks | 200/334 X |
| 4,283,608 | 8/1981 | Genz | 200/43.08 |
| 4,292,483 | 9/1981 | Roytberg | 200/43.03 |
| 4,419,546 | 12/1983 | Arthur | 200/565 X |
| 4,539,452 | 9/1985 | Draxler | 200/334 |
| 4,733,034 | 3/1988 | Armstrong et al. | 200/336 X |
| 4,839,478 | 6/1989 | Howard | 200/52 R |
| 4,890,006 | 12/1989 | Huang | 200/43.04 X |
| 4,981,121 | 1/1991 | Tani | 123/198 DC X |

FOREIGN PATENT DOCUMENTS

| | | | |
|---|---|---|---|
| 1149783 | 6/1963 | Fed. Rep. of Germany | 200/43.08 |

*Primary Examiner*—Henry J. Recla
*Assistant Examiner*—Glenn T. Barrett
*Attorney, Agent, or Firm*—Watts Hoffmann Fisher & Heinke

[57] ABSTRACT

A switch for controlling the operation of a motor boat comprises a cylinder and a key. The key includes a grippable knob and a detachable key actuator which engages a key-receiving member in the cylinder. The knob is turned from a first stable angular orientation (that is, an off-position) to a second stable angular orientation (that is, an on-position) to operate the motor. The knob is also coupled by means of a lanyard to the operator. If the operator falls overboard, the knob will separate from the key actuator and springs located inside the cylinder return the switch to the off-position. The switch also permits the a choke signal to be sent to the motor by pressing inwardly on the knob.

24 Claims, 5 Drawing Sheets

MARINE KEY SWITCH

FIELD OF THE INVENTION

The present invention relates generally to electrical switches for controlling the operation of motor craft, and more specifically to key-actuated switches which are automatically disabled when the operator of the craft is ejected from an operation position in the craft.

BACKGROUND OF THE INVENTION

One hazard of operating small watercraft such as motor boats is that the operator may be knocked overboard while the craft is in operation. After falling overboard, the hull or propeller of the craft may strike and injure the operator. In addition, the craft may continue to run after the operator falls overboard, making it difficult for the operator to retrieve the boat and return safely to shore.

It has been proposed to reduce the hazard of falling overboard by providing an electrical cut-off switch which disabled the motor if the operator was ejected from the craft. According to one such proposal, the cut-off switch took the form of a push button switch. A lanyard was coupled at one end to the operator and was clipped or tied at the other end to a stem below the actuating surface of the push button switch. When the lanyard was engaged with the cut-off switch, the motor was enabled to operate. If the operator then fell overboard, the lanyard pulled loose from the switch so that the switch disabled the motor. After the lanyard has been pulled loose, the operator might restart the motor by depressing the push button switch.

One drawback to this proposal was that the push button cut-off switch provided no security against unauthorized operation of the boat. Furthermore, the cut-off switch made no provision for energizing a starter solenoid when the motor was started. This required that other electrical switches be provided on the motor to facilitate starting. These other switches increased the cost of the motor as well as the likelihood of a failure of the motor's electrical system.

DESCRIPTION OF THE INVENTION

These drawbacks and others are overcome by a key actuated switch for controlling the operation of a motor. An embodiment of the switch includes a cylinder and a detachable key. The key comprises a grippable knob and a key actuator. The key actuator has a keyed portion and an oppositely directed knob engaging device for detachable engagement with the knob.

The cylinder comprises a housing, a rotor rotatably supported by the housing, a contact supported for rotation with the rotor, and a plurality of terminals. The housing includes an opening for receiving the key actuator. The rotor is rotatably supported in the housing for rotation with the key actuator when the key actuator is received in the housing. The housing and knob define first and second stable angular orientations of the rotor corresponding to a run and stop position. A biasing device biases the rotor toward the first stable angular orientation so that the rotor returns to the first stable angular orientation if the knob is disengaged from the key actuator.

The plurality of terminals includes at least two terminals constructed and arranged for electrical connection with the contact when the key actuator is in the second stable angular orientation. This means that an operator may insert the key through the opening in the housing and turn the contact from a first stable angular orientation in which these two contacts are not bridged to the second stable angular orientation in which the contact bridges at least these two terminals. Once turned, the key actuator is maintained in the second stable angular orientation by the housing and knob.

If sufficient outward force is applied to the knob while the key actuator is in the second stable angular orientation, the knob detaches from the key actuator and disengages from the housing. A positioning device on the knob is no longer cooperating with a positioning device on the housing, and a biasing device forces the key actuator, rotor and contact from the second stable angular orientation toward the first stable angular orientation. Since the contact is no longer in the second stable angular orientation, the two terminals are no longer bridge.

In another embodiment, the switch includes a lanyard coupled at one end portion to the knob for disengaging the knob from the key actuator when a force is applied to another end portion of the lanyard.

According to one application, the other end of the lanyard is clipped to the operator's clothing. The switch is mounted in the instrument panel of the motor boat for controlling the flow of current from the battery to the engine accessories. Preferably for this application, three terminals are provided for connection to the engine magneto, battery and ground. When the contact is in the first stable angular orientation, the magneto and ground terminals are bridge; in the second stable angular orientation, the accessories and battery terminals are bridged. Consequently, the motor is operable when the contact is in the second stable angular orientation and inoperable when the contact is in the first stable angular orientation.

When the operator turns the key so that the rotor and contact rotate from the first stable angular orientation to the second stable angular orientation, the motor becomes operable. Since the positioning means on the knob and housing maintain the rotor in the second stable angular orientation, the motor continues to run unless disabled by the operator as long as the operator remains in the boat. Should the operator fall overboard, however, the lanyard will pull the knob away from the key actuator. The key actuator, rotor and contact will immediately rotate toward the first stable angular orientation under the effect of the biasing means. As the contact rotates toward the first stable angular orientation, the motor will be disabled, allowing the operator to return to the boat and restart the motor.

According to still another embodiment of the invention, the key actuator includes at least one tooth and the housing has a lip overhanging the opening for engagement with the tooth to restrict the movement of the keyed portion out of receipt in the opening in the housing when the key actuator is in the second stable angular orientation. This helps to prevent the key from accidentally disengaging from the switch while the engine is running. It also helps to prevent the key actuator from pulling loose from the cylinder when a force is applied to pull the knob away from the key actuator.

According to yet another embodiment, the knob engaging means on the key actuator includes a prong for frictional engagement with a socket in the knob. The socket and prong frictionally engage to hold the knob and key actuator together until a sufficient force is applied, such as that generated by the operator falling overboard, to separate the knob from the key actuator.

According to another embodiment, the switch includes a key-receiving member having a shaft portion and a keyed recess for receiving the keyed portion of the key actuator. The shaft portion has a non-circular profile for slidable engagement with a matching through passage in the rotor. The key-receiving member can drive the rotor angularly in response to rotation of the key actuator and laos move axially with respect to the rotor.

In this embodiment, the terminals include a central terminal aligned with a central axis of the shaft portion and at least two terminals spaced from the central terminal for electrical connection by the contact when the rotor is in the second stable angular orientation. Furthermore, the switch includes a cantilevered contact electrically engaged at one end with one of the two terminals spaced from the central terminal and aligned at another end between the central terminal and the shaft portion of the key-receiving member. The cantilevered contact is designed to electrically connect that one of the two terminals and the central terminal when a force is applied to the shaft portion against the bias of the shaft biasing means to slide the end of the shaft portion toward the central terminal, such as by depressing the key in the cylinder.

One application of this embodiment is as a switch having the additional feature of choke control. According to this application, the central terminal is coupled to the choke control and another of the terminals is coupled to the battery. When it is desired to activate the choke, the key is depressed into the cylinder, thereby connecting the battery and choke terminals to send a choke signal to the motor.

The rotor, contact, biasing means and rotor biasing means are enclosed by a housing. The key receiving member includes a face for spanning the housing and an annular seal for preventing moisture from passing through the housing to the contact. The switch includes a back plate in water-tight engagement with the housing for sealing the back of the switch against moisture. Finally, the terminals consist of terminal studs passing through the back plate for communication outside the housing. These features in combination provide a water-tight switch suitable for marine applications.

In yet another embodiment, the housing has a lip overhanging an opening into which the knob fits. The knob includes a pair of oppositely directed outwardly-biased detents. Two pairs of recesses in the lip engage the detents to define the first and second stable angular orientations of the key actuator when the key actuator is in engagement with the knob. The positions of the two recesses in the lip define the two stable angular orientations.

In another embodiment, the rotor includes a pocket defined by a radial back wall portion and a pair of annular side wall portions. The housing includes a stop which extends into the pocket. The rotor biasing device comprises a compression spring trapped in the pocket between the back wall and the stop. These features combine to provide a simple and inexpensive device for angularly biasing the rotor.

In still another embodiment, the switch includes a back plate in engagement with the housing having a back plate stop surface. The rotor includes a rotor stop surface for abutment with the back plate stop surface to limit the permissible angular movement of the rotor.

According to a preferred embodiment of the invention, a switch comprises a housing having an opening at one end for receiving a key; a key-receiving member including a shaft portion and a keyed recess communicating outside the housing through the opening for receiving a keypad portion of the key; a rotor rotatably supported by the housing having a central hole with a non-circular profile mating with a non-circular profile of the shaft portion for slidable engagement; a shaft biasing device for biasing the key-receiving member away from the rotor; a contact supported for rotation with the rotor; a positioning device for defining a first and a second stable angular orientation of the key-receiving member, rotor and contact; a plurality of terminals, including a central terminal aligned with a central axis of the shaft portion and at least two terminals spaced from the central terminal for electrical connection by the contact when the rotor is in the second stable angular orientation; and a cantilevered contact electrically engaged at one end with one of the two terminals spaced from the central terminal and aligned at another end between the central terminal and an end of the shaft portion. This preferred embodiment provides two independent modes of stitching, through either the rotation of the rotor to bridge the two terminals spaced from the central terminal or through electrically connecting one of the two terminals and the central biasing means.

In another embodiment, the switch includes rotor biasing means for biasing the rotor away from the second stable angular orientation toward the first stable angular orientation. A preferred form of the rotor biasing device is provided where the rotor includes a pocket defined by a radial back wall portion and a pair of annular side wall portions, the housing includes a top which extends into the pocket and the rotor biasing device comprises a compression spring trapped in the pocket between the back wall and the stop.

In yet another embodiment, the non-circular profile of the shaft portion is asymmetric with respect to a line perpendicular to an axis of the shaft portion so that the shaft portion may be inserted into the hole in only one relative angular orientation. It is also desirable that the contact be a contact plate having at least one raised surface for electrical contact with one of the terminals. Such a contact plate must be asymmetric with respect to the central axis of the shaft portion and so may only be installed in one direction.

In still another embodiment, the housing has a lip overhanging the opening and the positioning device comprise two pairs of recesses in the lip for engagement with a pair of detents supported by the key to define the first and second stable angular orientations of the key-receiving member, rotor and contact.

Another embodiment of the switch comprises a housing having an opening at one end for receiving a key; a key-receiving member including a keyed recess communicating outside the housing through the opening for receiving a keyed portion of such key; a contact supported in the housing for rotation with the key-receiving member; positioning means for defining a first and a second stable angular orientation of the key-receiving member; and a plurality of terminals, including at least two terminals constructed and arranged for electrical connection by the contact when the key-receiving member is in the second stable angular orientation. At least a portion of the length of the keyed recess is internally prismatic, that is, having a non-trivial portion with an axis along which parallel cross-sectional profiles are identical, with a non-circular profile. Preferably, the switch also includes a rotor supporting the contact and supported in the housing for rotation with the key-receiving member, and rotor biasing means for biasing the rotor to rotate the key-receiving member away from the second stable angular orientation and toward the first stable angular orientation.

In another embodiment, the switch includes a post mounted in the key-receiving recess for engagement with a central bore in such keyed portion of such key for discriminating such key from other prismatic objects having a similar cross-section.

Another embodiment comprises a key for a switch comprising a grippable portion and a prismatic portion having a non-circular profile, the prismatic portion having a central bore for engagement with a post mounted in a mating key-receiving recess in such switch.

According to another embodiment, a switch comprises a housing having an opening at one end and a back plate at another end; a key-receiving member having a shaft portion and a keyed recess communicating outside the housing through the opening for receiving a key actuator, the shaft portion having a non-circular profile; a rotor rotatably supported by the housing having a central hole with a non-circular profile matching the non-circular profile of the shaft portion for slidable engagement with the shaft portion; and a shaft biasing device for biasing the key-receiving means away from the rotor. The rotor and housing each including a stop surface for abutment to define a first angular orientation. The switch also includes a rotor biasing device for biasing the rotor away from a second angular orientation toward the first angular orientation; a contact supported for rotation with the rotor; and a plurality of terminals penetrating the back plate for communication outside the housing, including at least two terminals constructed and arranged for electrical connection with the contact when the rotor is in the second angular orientation.

According to yet another embodiment, the non-circular profile of the shaft portion is asymmetric with respect to a line perpendicular to an axis of the shaft portion so that the shaft portion may be inserted into the hole in the rotor in only one relative angular orientation.

According to still another embodiment, the plurality of terminals includes a central terminal penetrating the back plate for communication outside the housing and at least two terminals spaced from the central terminal for electrical connection by the contact when the rotor is in the second stable angular orientation. The central terminal being aligned with a central axis of the shaft portion. The switch also includes a cantilevered contact electrically engaged at one end with one of the two terminals spaced from the central terminal and aligned at another end between the central terminal and an end of the shaft portion to electrically connect said one of the two terminals and the central terminal when a force is applied to the shaft portion against the bias of the shaft biasing means to slide the end of the shaft portion toward the central terminal.

In another embodiment of the invention, the rotor, contact, biasing means and rotor biasing means are enclosed by the housing and the key receiving member includes a face for spanning the opening and an annular seal surrounding the face for preventing moisture from passing through the opening to the contact.

In yet another embodiment, the contact is a contact plate having at least one raised surface for electrical contact with one of the terminals.

According to another embodiment, the rotor includes a pocket defined by a radial back wall portion and a pair of annular side wall portions, the housing includes a stop extending into one of the pockets and the rotor biasing means comprises a compression spring trapped in the pocket between the back wall and the stop.

Finally, an embodiment of a switch for controlling the operation of a motor comprises a lanyard, a knob, key actuator, a housing, a key-receiving member, a rotor, a shaft biasing means for biasing the key-receiving member away from the rotor, a contact plate, a plurality of terminals and a cantilevered contact.

The knob includes a grippable portion coupled to the lanyard and a body portion. The cylindrical portion mounts a pair of oppositely directed, outwardly-biased detents. The cylindrical portion also includes a socket opening oppositely to the grippable portion. The key actuator has a keyed portion, an oppositely directed prong for frictional engagement with the socket in the knob and a laterally directed tooth.

The housing includes an opening at one end for removably receiving the key actuator. The opening is defined by a lip having a pair of recesses for cooperating with the detents to define first and second stable angular orientations of the key actuator. Furthermore, the lip is constructed and arranged to engage the tooth on the key actuator to restrict the movement of the key actuator out of receipt in the opening in the housing when the key actuator is in the second stable angular orientation.

The key-receiving member includes a shaft portion with a non-circular profile and a keyed recess communicating outside the housing through the opening for receiving the key actuator. The rotor is rotatably supported by the housing and has a central hole with a non-circular profile matching the non-circular profile of the shaft portion for slidable engagement. The rotor also includes a pocket defined by a radial back wall portion and a pair of annular side wall portions. The housing including a stops extending into the pocket on the rotor.

The housing includes a back plate at an end opposite the opening. The rotor and back plate each includes a stop surface for abutment to limit the allowable angular movement of the rotor. A compression spring is trapped in the pocket between the back wall and the stop for biasing the rotor toward the first stable angular orientation and for returning the rotor to the first stable angular orientation when the knob is disengaged from the key actuator while the rotor and key actuator are in the second stable angular orientation.

The contact plate is keyed to the rotor and has at least two raised surfaces. The plurality of terminals penetrate the back plate for communication outside the housing. This plurality includes a central terminal aligned with a central axis of the shaft portion and at least two terminals spaced from the central terminal for electrical connection with the raised portions of the contact plate when the rotor is in the second angular orientation. The cantilevered contact is electrically engaged at one end with one of the two terminals spaced from the central terminal and aligned at another end between the central terminal and an end of the shaft portion. The cantilevered contact is designed to electrically connect the one of the annularly deployed terminals and the central terminal when a force is applied to the shaft portion against the bias of the shaft biasing means to slide the end of the shaft portion toward the central terminal.

From the foregoing, it is clear that one object of the invention is to provide a key switch that can be disabled when a force is applied to a grippable knob on the key, such as by a lanyard coupled to an operator who falls overboard while the switch is enabled. Another object of the invention is to provide a switch having two modes of operation, either as a key switch or as a push button switch. Yet another object of the invention is to provide a keys switch having a key switch which is simple and inexpensive to construct. These and other objects and advantages of the invention will become more apparent from the following detailed description of a preferred embodiment of the invention when considered along with the accompanying drawings.

DETAILED DESCRIPTION OF THE PREFERRED EMBODIMENT

Figure 1:
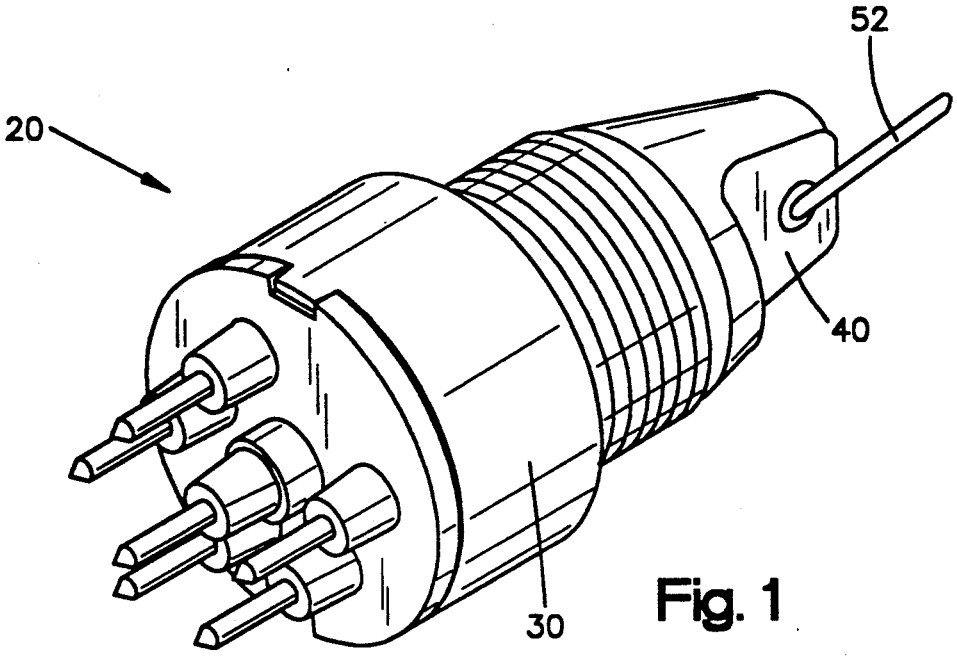
FIG. 1 is a perspective view of a key switch.

As shown in FIGS. 1–11, a preferred embodiment of a key switch 20 includes a cylinder 30 and a detachable key 40. The key 40 comprises a grippable knob 50 and a key actuator 60. One end of a lanyard 52 is coupled to the knob 50. The cylinder 30 comprises a housing 70; a key-receiving member 80; and O-ring 90; compression springs 100, 110 and 120; rotor 130, a contact plate 140, a plurality of terminals 150, 160, 170, 180, 190 and 200, a cantilevered contact 210 and a back plate 220.

Figure 2:
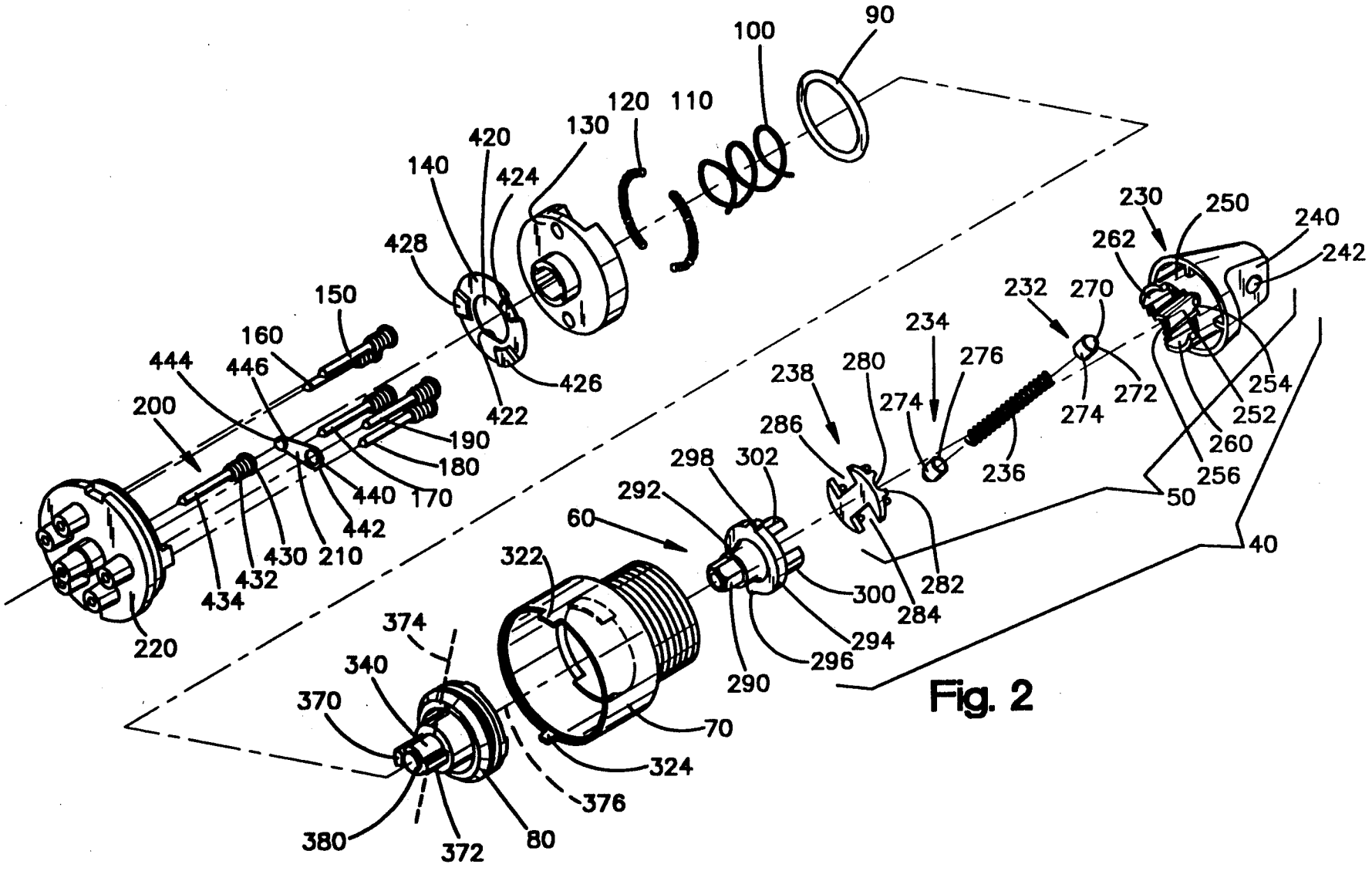
FIG. 2 is a disassembled view of the key switch of FIG. 1.

As best shown in FIG. 2, the knob 50 includes a grippable member 230, a pair of detents 232, 234, a compression spring 236 and a plate 238. The grippable member 230 defines a grippable portion 240 having a throughbore 242, and a body portion 250 defining a channel 252 terminating at each end in shoulders 254, 256, and a pair of sockets 260, 262. The detents are of identical shape, each comprising a rounded housing-engaging portion 270 (only one marked), a shoulder 272 and a hollow body portion 274. The plate 238 also defines a channel 280 terminating in shoulders 282 (only one shown) and apertures 284, 286 aligned with sockets 262, 264 in the grippable member 230.

When assembled, the detents 232, 234 and the compression spring 236 lie in the channel 252 with the housing-engaging portions 270 of the detents 232, 234 facing axially outwardly at either end of the channel 252. The compression spring 236 lies between the detents 232, 234 and biases the shoulders 272 on the detents 232, 234 against the shoulders 254, 256 at the ends of the channel 250. The plate 238 is fixed against the end of the grippable member 230 so that the channel 280 on the plate 238 is aligned with the channel 250 on the grippable member 230 and the sockets 260, 262 align with the apertures 284, 286.

Figure 3:
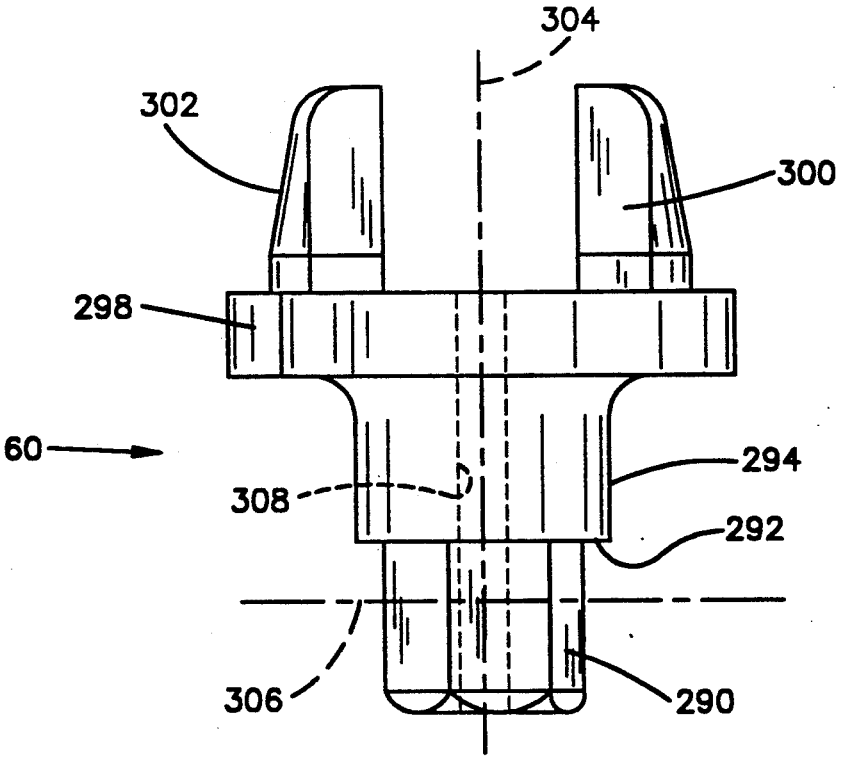
FIG. 3 is a side elevational view of a key actuator for a key switch.

As best shown in FIGS. 2 and 3, the key actuator 60 comprises a keypad portion 290 terminating in a shoulder 292, a body portion 294 supporting a pair of teeth 296, 296 on opposite sides of the body portion 292 and a pair of prongs 300, 302 directed oppositely from the keyed portion 290 for detachable engagement with the knob 50. In the embodiment shown, the keyed portion 290 is prismatic in that any cross-section of the keyed portion 290 taken orthogonal to the central axis 304 of the key actuator 60, such as along line 306, will be a regular hexagon. A central bore 308 passes through the center of the keyed portion 290 and the body portion 294 to distinguish the keyed portion 290 from a standard hex driver.

The key 40 is assembled by forcing the prongs 300, 302 on the key actuator 60 into the sockets 260, 262 in the knob 50. The prongs 300, 302 frictionally engage the walls of the sockets 260, 262 to detachably engage the key actuator 60 with the knob 50. Preferably, the prongs 300, 302 are tapered slightly to facilitate introduction of the prongs 300, 302 into the sockets 260, 262. While a single prong and socket might be used to couple the knob 50 and key actuator 60, the pair of prongs 300, 302 is preferred because the pair transmits rotation from the knob 50 to the key actuator 60 better than would a single prong.

Figure 4:
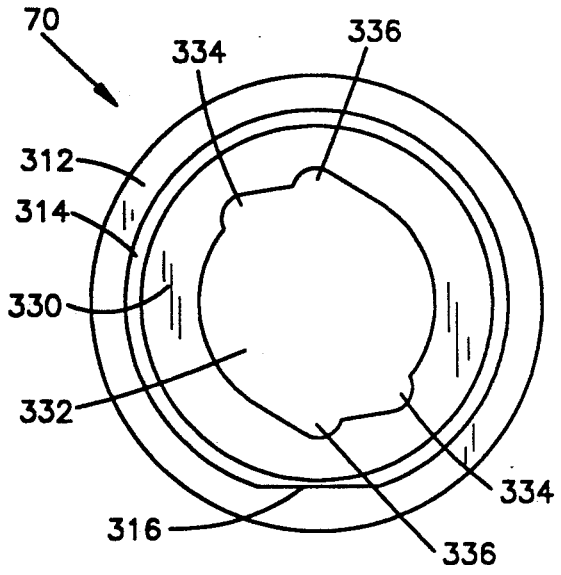
FIG. 4 is a top elevational view of a housing for the key switch of FIG. 1 showing an opening for receiving the key actuator.
Figure 5:
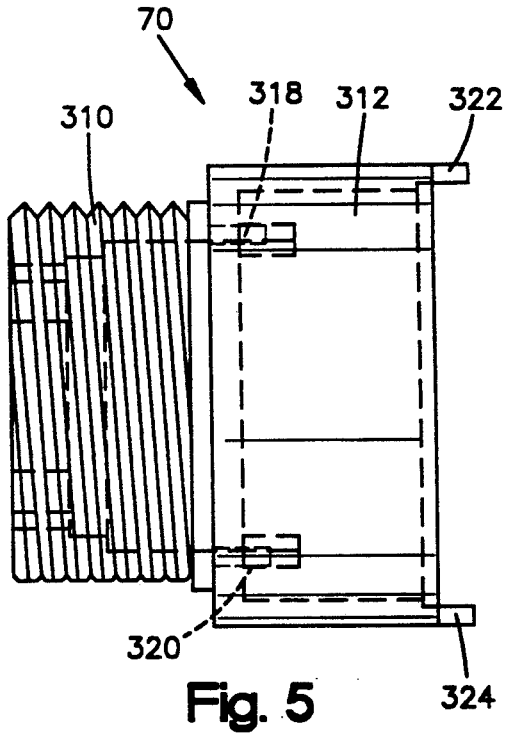
FIG. 5 is a side elevational view of the housing of FIG. 4.

As best shown in FIGS. 2, 4 and 5, the housing 70 is cylindrical with an upper threaded neck portion 310 and a lower portion 312 separated by a shoulder 314. The threaded neck portion 310 and shoulder 314 have a fattened side portion 316. Two stops 318, 320 project axially from the shoulder 314 into the interior of the lower portion 312 of the housing 70. Two tabs 322, 324 project from the lower edge of the lower portion 312 to position the back plate 220 at the base of the housing 70.

A lip 330 projects radially inwardly from the upper edge of the threaded neck portion 310. At the center of the lip 330 is an opening 332 which leads to the interior of the housing 70. The opening 332 has a generally circular cross-section except for two pairs of recesses 334, 336 which cooperate with the detents 232, 234 to define first and second stable angular orientations of the key-receiving member 80, rotor 130 and contact plate 140. In the embodiment shown in the drawing, the key 40 would be inserted into the opening 332 in a first angular orientation such that the detents 232, 234 on the knob 50 engage the recesses 334 and the teeth 296, 298 on the key actuator 60 enter the housing through the recesses 336. The profiles of the teeth 296, 298 are preferably arcuate so as to enter the housing 70 easily through the recesses 336. In an alternative embodiment, the lip 330 may include a third set of recesses to permit entry of the teeth 296, 298.

If the knob 50 is turned in a clockwise direction after the key 40 is inserted into the housing 70, the detents 232, 234 are rotated from engagement with recesses 334 to engagement with the recesses 336. In this second angular orientation of the key 30, the teeth 296, 298 are restrained under the lip 330 so that the key actuator 60 cannot be removed from the housing 70 through the opening 332. The key actuator 60 can only be removed by first rotating the key 40 counter-clockwise to return the key 40 to the angular orientation in which it was inserted through the opening 332. The angular orientations of the key 40 in which the detents 232, 234 engage either the recesses 334 or the recesses 336 are stable in the sense that the housing-engaging portions 270 of the detents 232, 234 are biased into the recesses by the compression spring 236 and resist further rotation of the key 40. The detents 232, 234 retract into the channel 252 in the body portion 250 of the knob 50 against the bias of the compression spring 236 when the operator applies a torque to the grippable portion 240 of the knob 50 to turn the key 40 in the housing 70.

Figure 6:
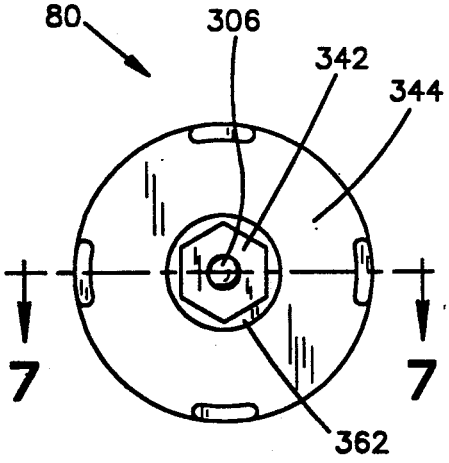
FIG. 6 is a top elevational view of a key-receiving member for the key switch of FIG. 1.
Figure 7:
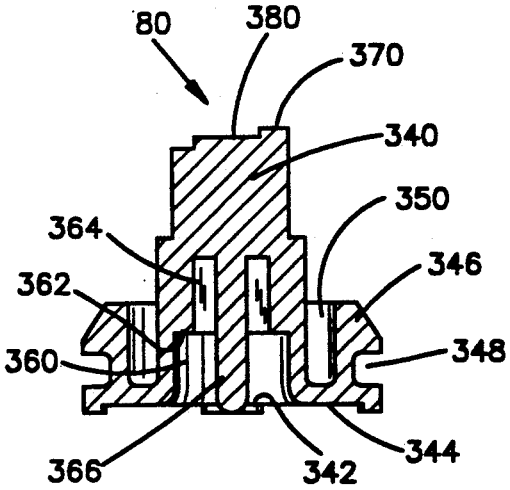
FIG. 7 is a side elevational view of the key-receiving member of FIG. 6 taken along line 7—7 in FIG. 6.

As best shown in FIGS. 2, 6 and 7, the key-receiving member 80 includes a shaft portion 340 and a keyed recess 342 opening in the center of a face 344. The face 344 has a sufficient diameter to span the opening 332 (FIG. 4). A rim 346 surrounds the face 344 and defines an annular channel 348 which mounts and positions an annular seal such as an O-ring 90 that inhibits moisture from passing through the opening 322 (see FIG. 4) to the contact plate 140. On a side opposite the face 344, the rim 346 defines a spring-receiving recess 350 for positioning a compression spring 100.

The keyed recess 342 includes an internally cylindrical portion 360 terminating in a shoulder 362 and an internally prismatic portion 364 having a non-circular profile matching the prismatic profile of the keyed portion 290 of the key actuator 60 so that the key-receiving member 80 may be rotated with the key actuator 60. A post 366 is mounted at the center of the keyed recess 342 which engages the bore 308 through the keyed portion 290. The non-circular profile of the internally prismatic portion 364 and the post 366 cooperate to prevent unauthorized users from activating the switch 20 without access to the key 40. While the internally prismatic portion 364 shown in the drawing has a hexagonal cross-section, a less regular cross-section may be preferred so as to decrease the likelihood of unauthorized activation of the switch 20.

As best seen in FIG. 2, the shaft portion 340 of the key-receiving member 80 has a non-circular profile. More specifically, the shaft portion 340 mounts two ribs 370, 372. In the embodiment shown in FIG. 2, rib 370 is larger than rib 372 such that the cross-section of the shaft portion 340 is asymmetric with respect to an imaginary line 374 orthogonal to an axis 376 of the shaft portion which passes between the two ribs 370, 372. The shaft portion 340 also includes a raised portion 380 at its end for contact with the cantilevered contact 210 when the key-receiving member 80 is depressed against the bias of the compression spring 100.

Figure 8:
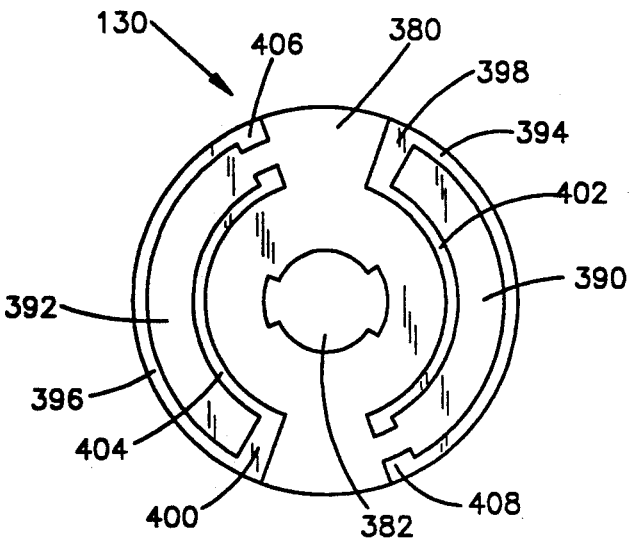
FIG. 8 is a top elevational view of a rotor for the switch of FIG. 1.
Figure 9:
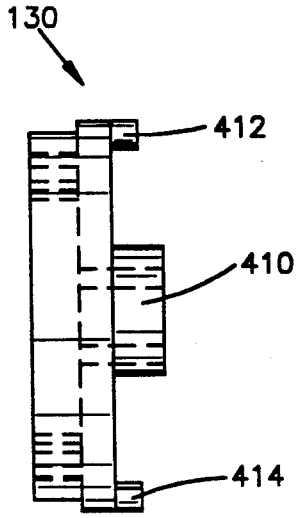
FIG. 9 is a side elevational view of a rotor of FIG. 8.

As best shown in FIGS. 2, 8 and 9, the rotor 130 comprises a central disc portion 380 having a central hole 382 having a non-circular profile matching the profile of the shaft portion 340 of the key-receiving member 80 so that the rotor rotates with the key-receiving member 80 and ultimately with the key actuator 60. Since the profile of the shaft portion 340 is asymmetric with respect to the line 374, the shaft portion 340 can only be inserted into the central hole 382 in one relative orientation. The upper surface of the central disc portion 380 mounts a pair of pockets 390, 392 for trapping compression springs 110, 120 which act as means to bias the rotor 130 away from a second stable angular orientation toward a first stable angular orientation. The pockets 390, 392 are defined by outer annular wall portions 394, 396, radial back portions 398, 400 and inner annular wall portions 402, 404 rising axially out of the upper surface of the central disc portion 380.

The rotor 130 is supported in the housing 70 for rotation with the key actuator 60 when the key actuator 60 is received by the opening 332 in the housing 70. When the rotor 130 is positioned so that the stops 318, 320 (see FIG. 5) mounted inside the housing extend into the pockets 390, 392. The compression springs 110, 120 are trapped between the stops 318, 320 and the radial back wall portions 398, 400 so that the springs 110, 120 are compressed by the stops 318, 320 when the rotor 130 is rotated clockwise with respect to the housing 70.

The condition in which the springs 110, 120 are most relaxed and the stops 318, 320 abut the wall portions 406, 408 of the pockets 390, 392 defines the first stable angular orientation. The recesses 334, 33 in the lip 330 of the housing 70, the key-receiving member 80, the rotor 130 and the stops 318, 320 should all be aligned and orientated so that the detents 232, 234 on the knob 50 enter the recesses 334, the teeth 298 on the key actuator 60 enter the recesses 336 and the keyed portion 290 of the key actuator 60 enters the keyed recess 342 of the key-receiving member 80 when the rotor 130 is oriented so that the stops 318, 320 abut the wall portions 406, 408. Since the second stable angular orientation of the rotor 130, as defined by the detents 232, 234 and recesses 334, 336, is clockwise from the first stable angular orientation, the resistance of the springs 110, 120 to compression biases the rotor, key-receiving member 80 and key actuator 60 away from the second stable angular orientation toward the first stable angular orientation.

As indicated previously, a compression spring 100 is trapped between the spring-receiving channel 350 on the key-receiving member 80 (see FIG. 7) and the inner annular wall portions 402, 404 on the rotor 130. The compression spring 100 biases the key-receiving member 80 away from the rotor 130. In addition, the spring 100 passes the face 344 against the underside of the lip 330 (see FIG. 4) surrounding the opening 332 in the housing 70 so as to impede the passage of moisture into the housing 70.

A sleeve portion 410 surrounding the central hole 382 and a pair of stops 412, 414 project axially from a lower surface of the central disc portion 380 of the rotor 130. The sleeve portion 410 has a generally circular profile except for a fattened side (not shown). As best shown in FIG. 2, a contact plate 140 is frictionally supported by the sleeve 410 against the lower surface of the rotor 130. The contact plate 140 includes a central hole 420 having a generally circular profile except for a straight portion 422 which engages with the flattened portion of the sleeve portion 410 to key the contact plate 140 for rotation with the rotor 130.

The metallic, electrically-conductive contact plate 140 includes three raised portions 424, 426 and 428 which engage the terminals 150, 160, 170, 180, 190. In the embodiment shown, the raised portion 424 is narrower than the raised portions 426, 428 and the raised portions 424, 426 are closer together than either of the raised portions 424, 42 is to the raised portion 428.

Beneath the contact plate 140 is a plurality of terminals including a central terminal 200 and five terminals 150, 160, 170, 180, 190 spaced from the central terminal 200 for electrical connection by the contact plate 140. The terminals 150, 160, 170, 180, 190, 200 are identical in construction. For example, terminal 200 consists of a stud having a head portion 430, a knurled neck portion 432 and a leg portion 434 for communication outside the housing 70.

Also beneath the contact plate 140 is a cantilevered contact 210. The cantilevered contact 140 consists of an elongated metallic, electrically conductive web. The cantilevered contact 210 includes a hole 440 in a proximal end portion 442 through which the terminal 190 passes to fasten the cantilevered contact 210 to the back plate 220. A contact surface 444 on the distal end portion 446 of the cantilevered contact 210 is aligned between the central terminal 200 and the lower end of the shaft portion 340 of the key-receiving member 80 to electrically connect the terminal 190 and the central terminal 200 when a force is applied to the shaft portion against the bias of the compression spring 100 to slide the lower end of the shaft portion 340 toward the central terminal 200.

Figure 10:
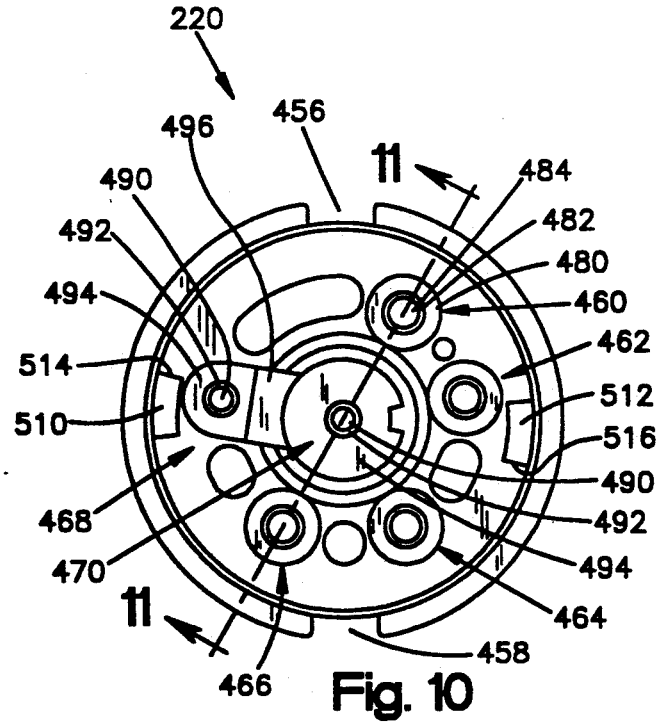
FIG. 10 is a top elevational view of a bottom plate for the switch of FIG. 1.
Figure 11:
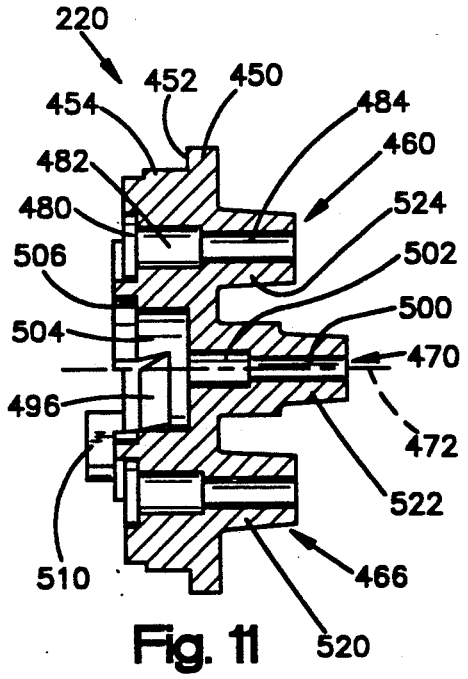
FIG. 11 is a side elevational view of the bottom plate of FIG. 10 taken along the line 11—11 in FIG. 10.

Finally, as best shown in FIGS. 2, 10 and 11, a back plate 220 is in water-tight engagement with the housing 70 for sealing the back of the switch 20 against moisture. The back plate 220 includes a plate portion 450 terminating in a shoulder 452 which abuts the lower edge of the lower portion 312 of the housing 70 to seal the switch 20. The back plate also includes an insert portion 454 which is inserted into the lower portion 312 of the housing 70. The plate portion 450 includes a pair of slots 456, 458 which engage the taps 322, 324 respectively to orient the back plate 220 relative to the housing 70. In the embodiment shown in the drawing, tab 324 and slot 458 are smaller than the tab 322 and slot 456 so that the back plate 220 can be oriented in only one way relative to the housing 70.

The back plate 220 is penetrated by six bores 460, 462, 464, 466, 468, 470 through which the terminals 150, 160, 170, 180, 190, 200 penetrate the back plate 220 for communication outside the housing 70. The bore 470 is centered on a central axis 472 of the back plate 220 while the bores 460, 462, 464, 466, 468 are spaced from the central axis 472.

Each of the bores 460, 462, 464, 466, 468, 470 is of circular cross-section. The bores 460, 462, 464, 466 have identical internal profiles. Taking bore 460 as an example, the internal profile consists of three sections 480, 482, 484 of narrowing inner diameter. When the terminals 150, 160, 170, 180 penetrate the bores 460, 462, 464, 466, the leg portions 434 fit snugly through the lower sections 484 and the knurled neck portions 432 fit snugly into the middle sections 482, while the head portions 430 sit in the upper sections 480 for engagement with the raised portions 424, 426, 428 of the contact plate 140.

As with the bores 460, 462, 464, 466, the bore 468 includes a lower section 490 having a circular cross-section for receiving the leg portion 434 of the terminal 190 and a middle section 492, also of circular cross-section, for receiving the knurled neck portion 432 of the terminal 190. Unlike the middle sections 482 of bores 460, 462, 464, 466, however, the middle section 492 of the bore 190 opens through a plateau 494 which supports the proximal end 442 of the cantilevered contact 210. When assembled, the knurled neck portion 432 of the terminal 190 passes through the hole 440 in the cantilevered contact 210 so that the proximal portion 442 of the cantilevered contact 210 is trapped between the head 430 of the terminal 190 and the plateau 494 on the back plate 220. The cantilevered contact 210 extends over an inclined surface 496 adjacent the plateau 494 so that the contact surface 444 on the distal end portion 446 of the cantilevered contact 210 is aligned with the central axis 472 of the back plate 220 over the central terminal 200.

As with bores 460, 462, 464, 466, 468, the central bore 470 includes a lower section 500 having a circular cross-section for receiving the leg portion 434 of the central terminal 200 and a middle section 402, also of circular cross-section for receiving the knurled neck portion 432 of the terminal 200. Like the terminals 150, 160, 170, 180, the middle section 502 of the central bore 200 opens up into an upper section 504 of circular cross-section in which the head 430 of the central terminal 200 sits. Unlike the upper sections 480 of the bores 460, 462, 464, 466, however, the upper section 504 of the central bore 470 forms a chamber having a gap in one side communicating past the inclined surface 496 with the plateau 494. The distal end portion 446 of the cantilevered contact extends into the upper section 504.

The upper section 504 of the central bore 470 opens past a shoulder 506 which supports the lower edge of the sleeve portion 410 of the rotor 130 for rotation with the key-receiving member 80. The length of the sleeve 410 must be selected so that the raised portion 424, 426, 428 of the contact plate 140 engage the heads 430 of one or more of the terminals 150, 160, 170, 180, 190.

The upper surface of the back plate 220 mounts a pair of stops 510, 512 which cooperate with the stops 412, 414 on the rotor 130 to limit the rotation of the rotor 130 with respect to the back plate 220. More specifically, the stops 510, 512 tend to limit the movement of the rotor 130 in a clockwise direction against the bias of compression springs 110, 120.

In the embodiment shown, the lower sections 484, 490, 500 of the bores 460, 462, 464, 466, 468, 470 are surrounded by sleeves (only three sleeves, 520, 522, 524, over bores 466, 470, 460, shown).

The grippable member 230, detents 232, 234, plate 238, key actuator 60, housing 70, key receiving member 80, rotor 130 and back plate 220 are each preferably a unitary acetal plastic molding. The contact plate 140 and cantilevered contact 210 are preferably stamped copper.

When used as a motor boat control, the switch 20 is installed through a hold in a motor boat dashboard (not shown) so that the shoulder 314 on the housing 70 abuts the rear surface of the dashboard and the threaded neck portion 310 extends through the hole to the front side of the dashboard. Preferably, one side of the threaded neck portion 310 is flattened so that the housing can be installed in only one angular orientation relative to the dashboard. A nut (not shown) may be threaded over the neck portion 310 to secure the switch 20 in place on the dashboard.

The terminals 150, 160, 170, 180, 190, 200 are connected to the electrical system of the boat as follows:

| Terminal | Connection |
|---|---|
| 150 | Starter Solenoid; |
| 160 | Ground; |

-continued

| Terminal | Connection |
|---|---|
| 170 | Accessory; |
| 180 | Engine Magneto; |
| 190 | Battery; and |
| 200 | Choke. |

Figure 12:
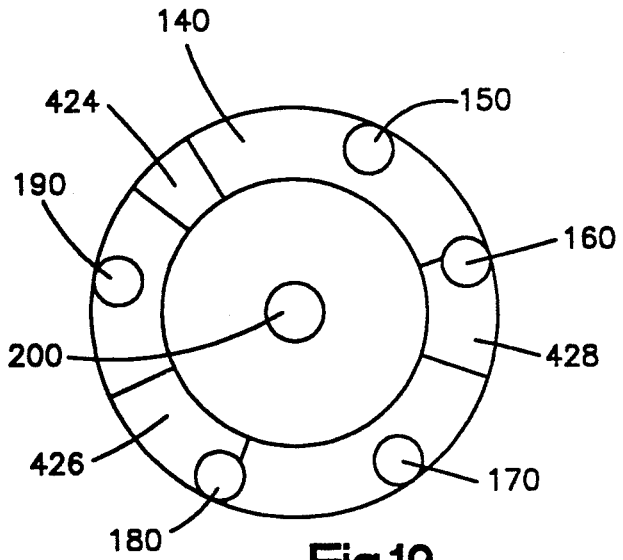
FIGS. 12–14 are top elevational views of the relationship between the conductive contact plate and the terminals.

When the key 40 is removed from the cylinder 30, the compression springs 110, 120 rotate the rotor 130 counter-clockwise into a first stable angular orientation in which the wall portions 406, 408 on the rotor 130 abut the stops 318, 320 on the housing 70. As best shown in FIG. 12, the raised portion 428 contacts the ground terminal 160 and the raised portion contacts the engine magneto terminal 180 to disable the motor. Consequently, the first stable angular orientation corresponds to a condition in which the motor is inoperative.

If the key 40 (that is, the knob 50 and key actuator 60 in engagement) is inserted while the rotor 130 is in the first stable angular orientation, the teeth 296, 298 enter the housing through the recess 336 in the lip 330 and the detents 232, 234 engage the recesses 334. The keyed portion 290 of the key actuator 60 enters the keyed recess 342 in the key-receiving member 80. At this point, the key actuator 60, key-receiving member 80, rotor 130 and contact plate 140 are coupled for rotation together when an operator turns the knob 50.

Figure 13:
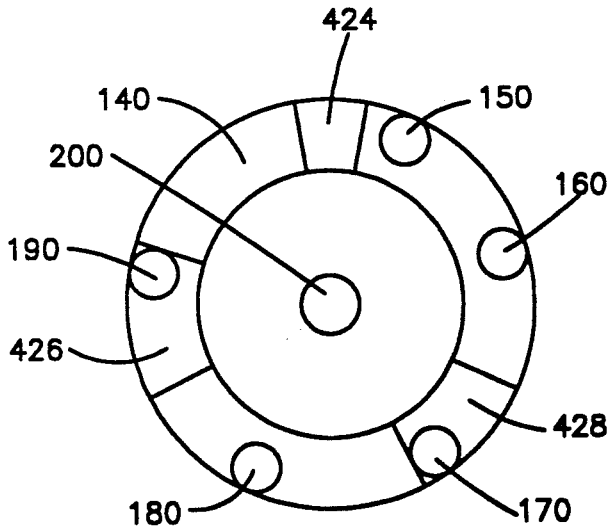
Figure 14:
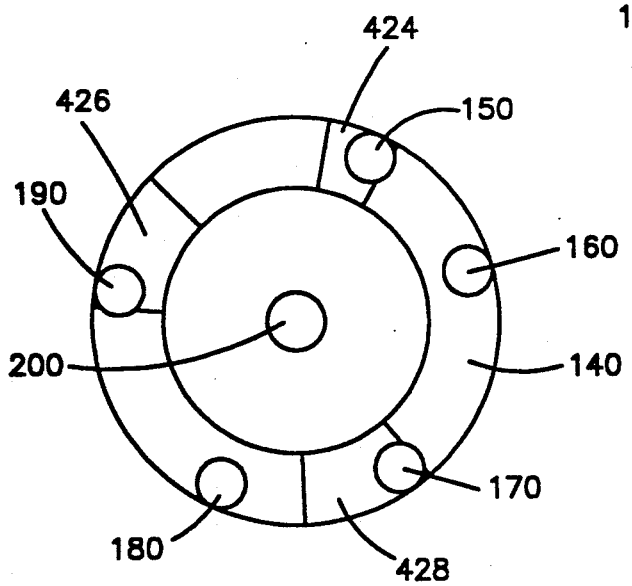

If an operator rotates the knob 50 clockwise against the bias of the compression springs 110, 120, the detents 232, 234 disengage from the recess 334 and engage the recesses 336. The second stable angular orientation of the key actuator 60, key-receiving member 80, rotor 130 and contact plate 140, defined by the engagement of the detents 232, 234 with the recesses 336, corresponds to a condition in which the motor is running. As best shown in FIG. 13, the raised portion 426 contacts the accessory terminal 170 and the raised portion 428 contacts the battery terminal 190. Since the teeth 296, 298 on the key actuator 60 are trapped under the lip 330 of the housing 70 while the key actuator 60 is in the second stable angular orientation, the key actuator 60 cannot be removed from the housing 70 while the motor is running.

While the boat is being operated, the lanyard 52 is clipped to the clothing of the operator by means of a plastic clip (not shown). If the operator falls overboard wile the motor is running, the lanyard pulls the knob 50 out of frictional engagement with the key actuator 60. Since the detents 232, 234 of the knob are no longer in engagement with the recesses 336, nothing opposes the bias of the compression springs 110, 120. The bias of these springs 110, 120 returns the rotor 130 and contact plate 140 to the first stable angular orientation. Once in the first stable angular orientation, the contact plate 140 shorts out the engine magneto, thereby disabling the motor until the operator returns to the boat and restarts the ignition.

If the operator desires to choke the motor, the operator presses inwardly on the knob 50. As the knob 50 is pressed inwardly, the key actuator 60 and key-receiving member 80 also slide axially inwardly against the bias of the compression spring 100. The shaft portion 340 of the key-receiving member 80 presses the distal end 446 of the cantilevered contact 210 downward so that the contact surface 444 of the cantilevered contact engages the central terminal 200. Since the cantilevered contact 210 is coupled than at one end to the battery terminal 190 and at the other end to the choke terminal 200, a choke signal is generated which passes through the choke terminal 200 to induce a choking of the motor.

In order to start the motor, the knob 50 is turned clockwise past the second stable angular orientation until the narrow raised portion 424 engages the starter solenoid terminal 150. During the rotation of the contact plate past the second stable angular orientation to the orientation in which the starter solenoid terminal 150 is contacted, the raised portion 428 remains in contact with the accessory contact 170 and the raised portion 426 remains in contact with the battery terminal 190. As a result, both the starter solenoid terminal 150 and the accessory terminal 170 are coupled to the battery terminal 190 in this starting orientation. The rotor 130 is prevented from rotating beyond this starting orientation by the interaction by the abutment of stops 510, 512 against stops 412, 414. The starting orientation is not stable in the sense that, once the knob 50 is released, the springs 110, 120 will bias the rotor 130 back into the second stable angular orientation (that is, the run position).

Many modifications and variations of the invention will be apparent to those skilled in the art in light of the foregoing disclosure. Therefore, it is to be understood that, within the scope of the appended claims, the invention can be practiced otherwise than has been specifically shown and described.

I claim:

1. A switch for controlling the operation of a motor comprising of:

a) a grippable knob;

b) a key actuator having a keyed portion and oppositely directed know engaging means for detachable engagement with the knob;

c) a housing having an opening for removably receiving the key actuator;

d) a rotor rotatably supported by the housing for rotation with the key actuator when the key actuator is received by the opening in the housing;

e) the housing and knob having positioning means which cooperate to define first and second stable angular orientations of the rotor and key actuator when the key actuator is in detachable engagement with the knob;

f) a contact supported for rotation with the rotor;

g) a plurality of terminals, including at least two terminals constructed and arranged for electrical connection with the contact when the key actuator is in the second stable angular orientation; and h) rotor biasing means for biasing the rotor toward the first stable angular orientation and for returning the rotor to the first stable angular orientation when the knob is disengaged from the key actuator while the rotor and key actuator are in the second stable angular orientation.

2. A switch according to claim 1 including a lanyard coupled at one end portion to the knob for disengaging the knob from the key actuator when a force is applied to another end portion of the lanyard.

3. A switch according to claim 1 wherein the key actuator includes at least one tooth and the housing has a lip overhanging the opening for engagement with the tooth to restrict the movement of the keyed portion out of receipt in the opening in the housing when the key actuator is in the second stable angular orientation.

4. A switch according to claim 1 wherein the knob engaging means includes a prong for frictional engagement with a socket in the knob.

5. A switch according to claim 1 including a key-receiving member having a shaft portion and a keyed recess for receiving the keyed portion of the key actuator, the shaft portion having a non-circular profile for slidable engagement with a central hole with a matching cross-section in the rotor for driving the rotor angularly in response to rotation of the key actuator; and shaft biasing means for biasing the key-receiving member away from the rotor.

6. A switch according to claim 5 wherein the non-circular profile of the shaft portion is asymmetric with respect to a line perpendicular to an axis of the shaft portion so that the shaft portion may be inserted into the hole in the rotor in only one relative angular orientation.

7. A switch according to claim 5 wherein;

the terminals include a central terminal aligned with a central axis of the shaft portion and at least two terminals spaced from the central terminal for electrical connection by the contact when the rotor is in the second stable angular orientation; and the switch includes a cantilevered contact electrically engaged at one end with one of the two terminals spaced from the central terminal and aligned at another end between the central terminal and an end of the shaft portion to electrically connect said one of the two terminals and the central terminal when a force is applied to the shaft portion against the bias of the shaft biasing means to slide the end of the shaft portion toward the central terminal.

8. A switch according to claim 5 wherein:

the rotor, contact, biasing means and the rotor biasing means are enclosed by the housing;

the key receiving member includes a face for spanning the opening and an annular seal surrounding the face for preventing moisture from passing through the opening to the contact;

the switch includes a back plate in water-tight engagement with the housing for sealing the back of the switch against moisture; and the terminals consist of studs passing through the back plate for communication outside the housing.

9. A switch according to claim 1 wherein the housing has a lip overhanging the opening and the positioning means comprise a pair of oppositely directed, outwardly-biased detents supported by the knob and two pairs of recessed in the lip for engagement with the detents to define the first and second stable angular orientations of the key actuator when the key actuator is in engagement with the knob.

10. A switch according to claim 1 wherein the terminals are deployed annularly and the contact is a contact plate having at least one raised surface for electrical contact with one of the terminals.

11. A switch according to claim 1 wherein:

the rotor includes a pocket defined by a radial back wall portion and a pair of annular side wall portions;

the housing includes a stop which extends into the pocket; and the rotor biasing means comprise a compression spring trapped in the pocket between the back wall and the stop.

12. A switch according to claim 1 including a back plate in engagement with the housing having a back plate stop surface wherein the rotor includes a rotor stop surface for abutment with the back stop surface to limit angular movement of the rotor against the bias of the rotor biasing means.

13. A switch comprising:

a) a housing having an opening at one end for receiving a key;

b) a key-receiving member including a shaft portion and a keyed recess communicating outside the housing through the opening for receiving a keyed portion of the key, the shaft portion having a non-circular profile;

c) a rotor rotatably supported by the housing having a central hole with a non-circular profile mating with the non-circular profile of the shaft portion for slidable engagement with the shaft portion;

d) shaft biasing means for biasing the key-receiving member away from the rotor;

e) a contact supported for rotation with the rotor;

f) positioning means for defining a first and a second stable angular orientation of the key-receiving member, rotor and contact;

g) rotor biasing means for biasing the rotor away from the second stable angular orientation toward the first stable angular orientation;

h) a plurality of terminals, including a central terminal aligned with a central axis of the shaft portion and at least two terminals spaced from the central terminal for electrical connection by the contact when the rotor is in the second stable angular orientation; and i) a cantilevered contact electrically engaged at one end with one of the two terminals spaced from the central terminal and aligned at another end between the central terminal and an end of the shaft portion to electrically connect said one of the two terminals and the central terminal when a force is applied to the shaft portion against the bias of the shaft biasing means to slide the end of the shaft portion toward the central terminal;

wherein:

the rotor includes a pocket defined by a radial back wall portion and a pair of annular side wall portions;

the housing includes a stop which extends into the pocket; and the rotor biasing means comprise a compression spring trapped in the pocket between the back wall and the stop.

14. A switch comprising:

a) a housing having an opening at one end for receiving a key;

b) a key-receiving member including a shaft portion and a keyed recess communicating outside the housing through the opening for receiving a keyed portion of the key, the shaft portion having a non-circular profile;

c) a rotor rotatably supported by the housing having a central hole with a non-circular profile mating with the non-circular profile of the shaft portion for slidable engagement with the shaft portion;

d) shaft biasing means for biasing the key-receiving member away from the rotor;

e) a contact supported for rotation with the rotor;

f) positioning means for defining a first and a second stable angular orientation of the key-receiving member, rotor and contact;

g) a plurality of terminals, including a central terminal aligned with a central axis of the shaft portion and at least two terminals spaced from the central terminal for electrical connection by the contact when the rotor is in the second stable angular orientation; and h) a cantilevered contact electrically engaged at one end with one of the two terminals spaced from the central terminal and aligned at another end between the central terminal and an end of the shaft portion to electrically connect said one of the two terminals and the central terminal when a force is applied to the shaft portion against the bias of the shaft biasing means to slide the end of the shaft portion toward the central terminal;

(i) wherein the housing has a lip overhanging the opening and the positioning means comprise two pairs of recesses in the lip for engagement with a pair of detents supported by the key to define the first and second stable angular orientations of the key-receiving member, rotor and contact.

15. A switch comprising:

a) a housing having an opening at one end for receiving a key;

b) a key-receiving member including a keyed recess communicating outside the housing through the opening for receiving a keyed portion of such key, at least a portion of the keyed recess being internally prismatic with a non-circular profile;

c) a contact supported in the housing for rotation with the key-receiving member;

d) positioning means for defining a first and a second stable angular orientation of the key-receiving member; and e) a plurality of terminals, including at least two terminals constructed and arranged for electrical connection by the contact when the key-receiving member is in the second stable angular orientation.

16. A switch according to claim 15 including a rotor supporting the contact and supported in the housing for rotation with the key-receiving member, and rotor biasing means for biasing the rotor to rotate the key-receiving member away from the second stable angular orientation and toward the first stable angular orientation.

17. A switch according to claim 15 including a post mounted in the key-receiving recess for engagement with a central bore in such keyed portion of such key for discriminating such key from other prismatic objects having a similar cross-section.

18. A switch comprising:

a) a housing having an opening at one end and a back plate at another end;

b) a key-receiving member having a shaft portion and a keyed recess communicating outside the housing through the opening for receiving a key actuator, the shaft portion having a non-circular profile;

c) a rotor rotatably supported by the housing having a central hole with a non-circular profile matching the non-circular profile of the shaft portion for slidable engagement with the shaft portion;

d) shaft biasing means for biasing the key-receiving member away from the rotor;

e) rotor biasing means for biasing the rotor away from a second angular orientation toward a first angular orientation;

f) the rotor and back plate each including a stop surface for abutment to limit the movement of the rotor against the bias of the rotor biasing means;

g) a contact supported for rotation with the rotor; and h) a plurality of terminals penetrating the back plate for communication outside the housing, including at least two terminals constructed and arranged for electrical connection with the contact when the rotor is in the second angular orientation.

19. A switch according to claim 18 wherein the non-circular profile of the shaft portion is asymmetric with respect to a lien perpendicular to an axis of the shaft portion so that the shaft portion may be inserted into the hole in the rotor in only one relative angular orientation.

20. A switch according to claim 18 wherein:

the plurality of terminals includes a central terminal penetrating the back plate for communication outside the housing and at least two terminals spaced from the central stable angular orientation, the central terminals being aligned with a central axis of the shaft portion; and the switch includes a cantilevered contact electrically engaged at one end with one of the two terminals spaced from the central terminal and aligned at another end between the central terminal and an end of the shaft portion to electrically connect said one of the two terminals and the central terminal when a force is applied to the shaft portion against the bias of the shaft biasing means to slide the end of the shaft portion toward the central terminal.

21. A switch according to claim 18 wherein:

the rotor, contact, biasing means and rotor biasing means are enclosed by the housing; and the key receiving member includes a face for spanning the opening and an annular surrounding the face for preventing moisture from passing through the opening to the contact.

22. A switch according to claim 18 wherein the plurality of terminals includes annularly deployed terminals and the contact is a contact plate having at least one raised surface for electrical contact with one of the terminals.

23. A switch according to claim 18 wherein:

the rotor including a pocket defined by a radial back wall portion and a pair of annular side wall portions;

the housing includes a stop extending into one of the pockets; and the rotor biasing means comprises a compression spring trapped in the pocket between the back wall and the stop.

24. A switch for controlling the operation of a motor consisting of:

a) a lanyard;

b) a knob including a grippable portion coupled to the lanyard and a body portion mounting a pair of oppositely directed, outwardly-biased detents and having a socket opening oppositely to the grippable portion;

c) a key actuator having a keyed portion, an oppositely directed prong for frictional engagement with the socket in the knob and a laterally directed tooth;

d) a housing having an opening at one end for removably receiving the key actuator and a back plate at an opposite end, the opening being defined by a lip having a pair of recesses for cooperating with the detents to define first and second stable angular orientations of the key actuator, the lip being constructed and arranged to engage the tooth on the key actuator to restrict the movement of the key actuator out of receipt in the opening in the housing when the key actuator is in the second stable angular orientation;

e) a key-receiving member having a shaft portion and a keyed recess communicating outside the housing through the opening for receiving the key actuator, the shaft portion having a non-circular profile;

f) a rotor rotatably supported by the housing having a central hole with a non-circular profile matching the non-circular profile of the shaft portion for slidable engagement with the shaft portion, the rotor including a pocket defined by a radial back wall portion and a pair of annular side wall portions;

g) shaft biasing means for biasing the key-receiving member away from the rotor;

h) the housing including a stops extending into the pocket on the rotor;

i) a compression spring trapped in the pocket between the back wall and the stop for biasing the rotor toward the first stable angular orientation and for returning the rotor to the first stable angular orientation when the knob is disengaged from the key actuator while the rotor and key actuator are in the second stable angular orientation;

j) the rotor and back plate each including a stop surface for abutment to limit angular movement of the rotor past the second stable angular orientation against the bias of the compression spring;

k) a contact plate keyed to the rotor having at least two raised surfaces;

l) a plurality of terminals penetrating the back plate for communication outside the housing, including a central terminal aligned with a central axis of the shaft portion and at least two terminals spaced from the central terminal for electrical connection with the raised portions to the contact plate when the rotor is in the second angular orientation; and m) a cantilevered contact electrically engaged at one end with one of the angularly deployed terminals and aligned at another end between the central terminal and an end of the shaft portion to electrically connect the one of the annularly deployed terminals and the central terminal when a force is applied to the shaft portion against the bias of the shaft biasing means to slide the end of the shaft portion toward the central terminal.

* * * * *